US006772898B1

(12) United States Patent
Florino et al.

(10) Patent No.: US 6,772,898 B1
(45) Date of Patent: Aug. 10, 2004

(54) CONTAINER FORMED BY TWO CHAMBERS CAPABLE OF BEING ASSEMBLED BY ONE OF THEIR SURFACES

(76) Inventors: Marc Florino, 50 avenue de Cannes, 06800 Cagnes (FR); Franck Legoupil, 11 route de Caen, 14500 Vire (FR)

( * ) Notice: Subject to any disclaimer, the term of this patent is extended or adjusted under 35 U.S.C. 154(b) by 27 days.

(21) Appl. No.: 10/130,966

(22) PCT Filed: Nov. 8, 2000

(86) PCT No.: PCT/FR00/03100

§ 371 (c)(1),
(2), (4) Date: May 23, 2002

(87) PCT Pub. No.: WO01/40065

PCT Pub. Date: Jun. 7, 2001

(30) Foreign Application Priority Data

Dec. 2, 1999 (FR) ..... 99 15438

(51) Int. Cl.[7] ..... B65D 21/02
(52) U.S. Cl. ..... 220/23.4
(58) Field of Search ..... 220/23.4, 23.83, 220/23.86; 215/10

(56) References Cited

U.S. PATENT DOCUMENTS 3,933,268 A 1/1976 Buske
3,994,408 A * 11/1976 Belitzky ..... 215/10
4,708,253 A 11/1987 Mednis
4,925,066 A * 5/1990 Rosenbaum ..... 222/129

FOREIGN PATENT DOCUMENTS

FR 2655619 6/1991
NL 9301506 4/1995

OTHER PUBLICATIONS

Translation of French Patent Document No. 2655619.*
Translation of Dutch Application Document No. 9301506.*

* cited by examiner

*Primary Examiner*—Stephen Castellano
(74) *Attorney, Agent, or Firm*—McCormick, Paulding & Huber LLP

(57) ABSTRACT

The present invention provides a container made up of two receptacles that can be assembled together via respective ones of their faces. According to the invention, the assembly face of each receptacle comprises in similar manner: a transversely-extending step in the form of a groove having a bottom trough; a bottom abutment; and top abutment; such that when in the head-to-tail position, the trough of the groove of each receptacle co-operates with the edge of the groove of the other receptacle, and the bottom abutment of each receptacle co-operates with the top abutment of the other receptacle, in such a manner as to assemble the two receptacles together, blocking relative displacement between them both in the transverse and in the longitudinal directions. The invention is applicable to packaging a variety of products, and in particular to packaging liquids.

8 Claims, 3 Drawing Sheets

CONTAINER FORMED BY TWO CHAMBERS CAPABLE OF BEING ASSEMBLED BY ONE OF THEIR SURFACES

CROSS-REFERENCE TO RELATED APPLICATIONS

This application is entitled to the benefit of and incorporates by reference essential subject matter disclosed in International Application No. PCT/FR00/03100 filed on Nov. 8, 2000 and French Patent Application No. 99/15438 filed on Dec. 2,1999.

The present invention relates to a container made up of two receptacles that can be assembled together via respective ones of their faces.

A particular application of the invention lies in packaging a variety of products, and in particular liquids.

The receptacles can thus be constituted by cans for packaging a variety of liquids.

BACKGROUND OF THE INVENTION

Document FR-A-2 765 557 discloses a container made up of two receptacles that can be reversibly secured to each other. In the container, the two receptacles are secured to each other via at least one of each of their faces, the face(s) concerned having fixing means that are invisible when the two receptacles are forming the container.

Although advantageous in numerous ways, that container can be presented in only a limited number of configurations because of the way its fixing means are designed.

Furthermore, those means have the drawback of needing to be manufactured specially which increases the overall cost of the container.

OBJECTS AND SUMMARY OF THE INVENTION

The invention makes it possible to remedy the drawbacks of present containers, and to do this it presents a novel container constituted by two assembled-together receptacles.

This container has the advantage of enabling the two receptacles to be assembled together in a manner that is highly characteristic and effective. The assembly means used are easily made in the bodies of the receptacles, particularly when the receptacles are made of molded plastics material.

The present invention also has the advantage of offering a container of a shape that is very particular and suitable for attracting the public, both on practical grounds and because of appearance.

Other objects and advantages appear from the following description which, nevertheless, does not limit the invention.

The present invention provides a container constituted by two receptacles suitable for assembling to each other via respective ones of their faces, wherein the assembly face of each receptacle comprises in similar manner:

a transversely-extending step in the form of a groove; and a bottom abutment and a top abutment;

whereby in a head-to-tail position, the trough of the groove of each receptacle co-operates with the edge of the groove of the other receptacle, and the bottom abutment of each receptacle co-operates with the top abutment of the other receptacle, so as to assemble the two receptacles together, blocking relative displacement between them both in the transverse and in the longitudinal directions.

The embodiments specified below constitute variants of the present invention:

it further comprises means for blocking the two receptacles laterally;

the blocking means are formed by at least one cavity formed in the assembly face of one of the receptacles and a portion in relief formed on the assembly face of the other receptacle, said portion in relief being suitable for inserting in the cavity;

each receptacle has both a cavity and a portion in relief;

the cavity is a furrow and the portion in relief is a ridge;

the groove is of rounded profile to facilitate assembly;

each receptacle presents a cap closing its opening, the bottom face of said cap constituting the top abutment;

the bottom abutment is a plane surface facing towards the base of the receptacle;

the bottom abutment is positioned at a distance from the base of the receptacle that corresponds substantially to the thickness of the cap; and each receptacle is made of a molded plastics material.

BRIEF DESCRIPTION OF THE DRAWINGS

The accompanying drawings are given by way of non-limiting indication. They show an embodiment of the invention. They make it easy to understand the invention.

MORE DETAILED DESCRIPTION

It can be advantageous for packaging certain products to make use of containers 1 presenting two receptacles that can be assembled together.

Figure 1:
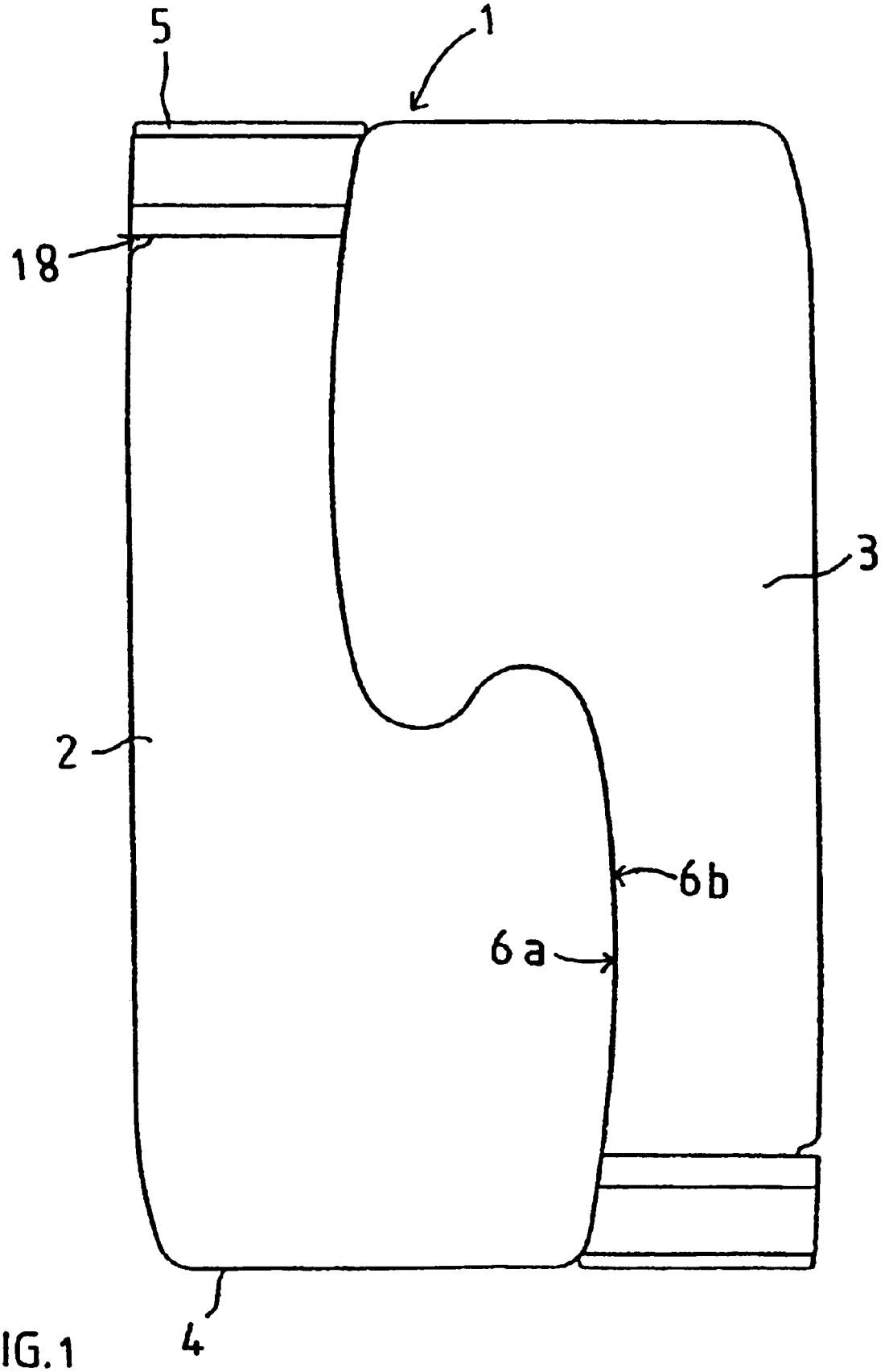
FIG. 1 is a side view of a container of the invention made up of two receptacles.

In this context and as shown in FIG. 1, the present invention provides a container 1 made up of two receptacles 2 and 3.

These receptacles 2 and 3 can be assembled to each other via respective ones of their faces given respective references 6*a* and 6*b*.

Figure 2:
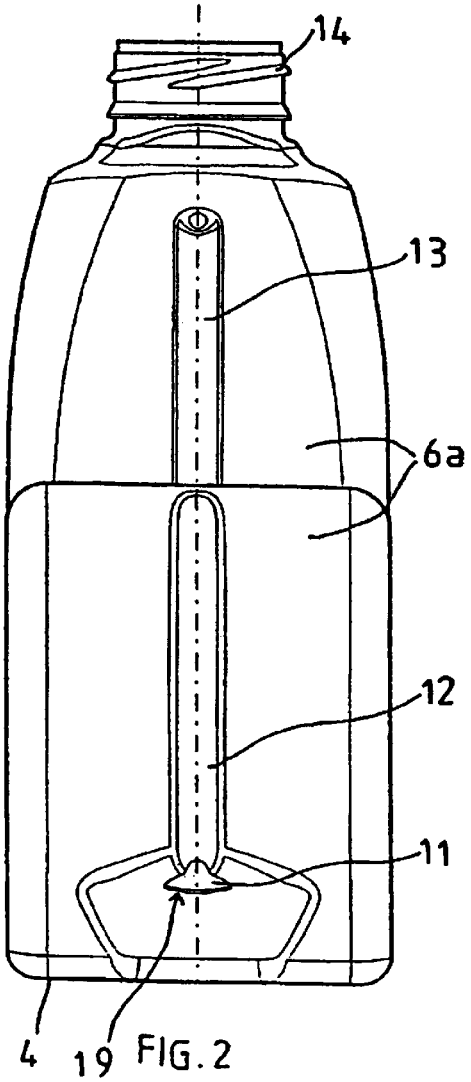
FIGS. 2, 3, 4, and 5 are respectively a front view, a side view, a bottom view, and a top view of one of the receptacles constituting the container of the present invention.

The assembly face 6*a* can also be seen in the front view of FIG. 2.

In order to enable the two receptacles 2, 3 to co-operate with each other via their respective assembly faces 6*a* and 6*b*, these faces present a special configuration that is characteristic of the invention.

The embodiment described below is one in which the two receptacles 2, 3 are substantially identical and present assembly faces 6*a*, 6*b* that are made in similar manner. However, the receptacles 2, 3 could be different, in particular they could have certain dimensions that are different, for example they could differ in the transverse direction 17.

Figure 3:
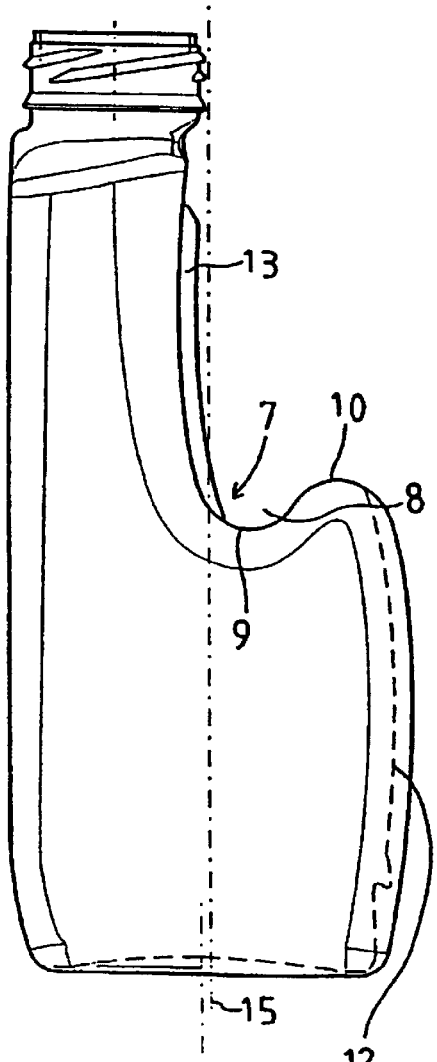

As shown in FIG. 3, the assembly face 6*a*, 6*b* comprises firstly a step 7 in the transverse direction. The transverse axis is referenced 17 in FIG. 4.

For the purposes of description, the lateral axis of each receptacle is referenced 16 and the longitudinal axis 15.

As shown in the side view of FIG. 3, the step 7 constitutes a change in the thickness of the receptacle and it includes a groove 8.

This groove comprises a trough 9 and an edge 10.

Furthermore, in the invention, the assembly face 6*a*, 6*b* has a bottom abutment 11 as shown in FIG. 2.

The bottom abutment 11 is preferably a plane surface 19 facing towards the bottom of the receptacle and projecting from the base of the receptacle 2, 3.

Each receptacle 2, 3 also has a top abutment suitable for co-operating with the bottom abutment by pressing against the plane surface 19 of said bottom abutment 11.

The two receptacles 2, 3 presenting respective assembly faces 6*a*, 6*b* configured in this way are suitable for co-operating as follows.

Firstly, the grooves 8 co-operate by inserting the edge 10 of one of the assembly faces 6*a* in the trough 9 of the other assembly face 6*b*. The reciprocal engagement also takes place. This co-operation can be seen clearly in FIG. 1.

The bottom abutment 11 of each receptacle 2, 3 also comes to bear against the top abutment of the other receptacle 2, 3.

Co-operation between the grooves 8 serves to block the receptacles 2, 3 against transverse relative displacement. The bottom and top abutments 11 serve to block the two receptacles 2, 3 in the longitudinal direction.

In a particular embodiment, the top abutment is constituted by the cap 5 closing the opening of the receptacle 2, 3. This variant is particularly suitable for packaging liquids, where the presence of a cap 5 co-operating with a thread 14 on each receptacle 2, 3 is commonplace.

The use of the cap 5 to constitute the top abutment has the advantage of requiring no additional means for making said abutment. Thus, the bottom face 18 of ordinary design of the cap 5 serves to constitute the top abutment.

Furthermore, in order to make it easier to assemble and disassemble the two receptacles 2, 3, the grooves 8 are preferably of rounded shape as shown in FIG. 3. The absence of any sharp angles makes it easier to put each edge 10 into position in the trough 9 of the other groove 8.

In a preferred embodiment, the container also has means for blocking the two receptacles 2, 3 in the lateral direction.

The use of such means ensures that the two receptacles 2, 3 are blocked against movement in all directions.

In a variant, the lateral blocking means are formed by at least one cavity formed in the assembly face 6*a*, 6*b* of one of the receptacles 2, 3 and a portion in relief formed on the assembly face 6*a*, 6*b* of the other receptacle 2, 3.

The cavity and the portion in relief are formed in such a manner as to co-operate with each other, the portion in relief being inserted into the cavity.

Figure 4:
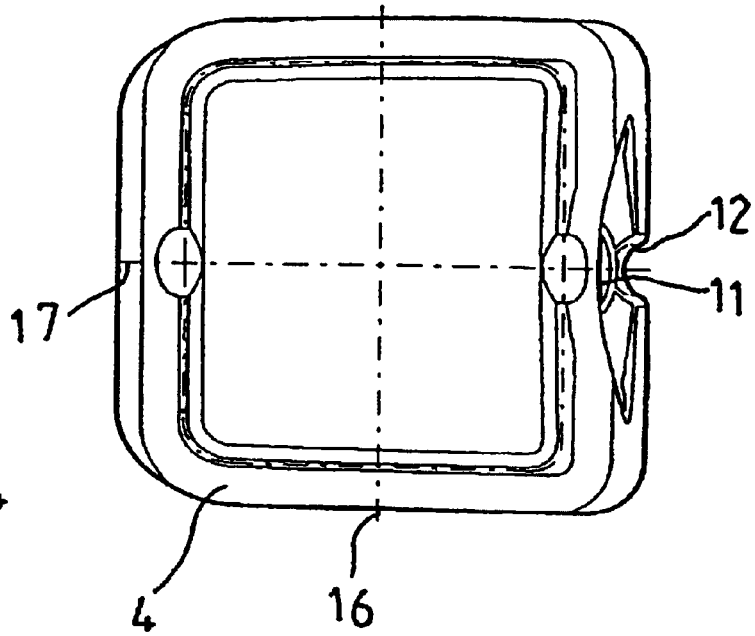
Figure 5:
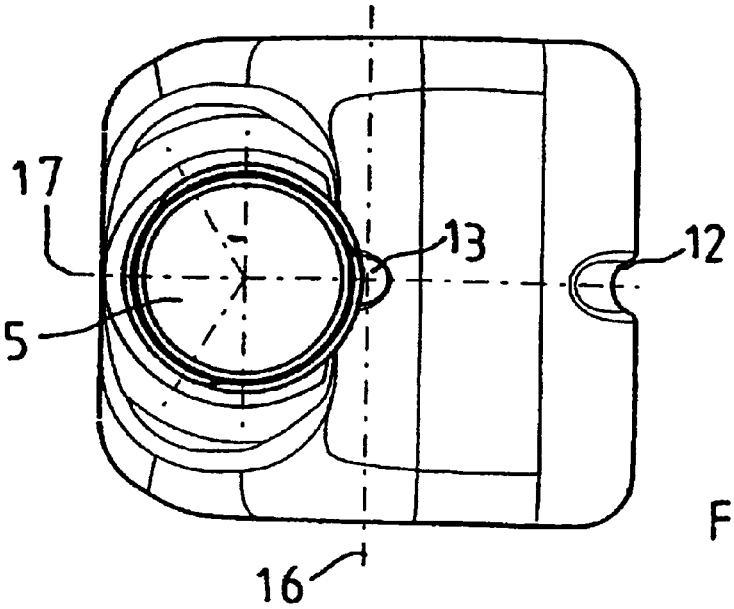

In a preferred embodiment, the cavity is a furrow 12 as shown in FIGS. 2, 4, and 5.

In this context, the portion in relief is a ridge 13 that can also be seen in FIG. 2 and in FIGS. 3 and 5.

When made in this way, the cavity and the portion in relief are of considerable length, thereby making them highly effective in blocking the two receptacles 2, 3 laterally.

The two receptacles 2, 3 are preferably made of a plastics material and they can be molded using any known means.

Furthermore, by selecting a plastics material that is sufficiently flexible (e.g. by limiting the thickness of the materials constituting the receptacles 2, 3) the operations of assembling and disassembling the receptacles 2, 3 are made easier by taking advantage of their elasticity.

Finally, it is advantageous for a container 1 to be made up that presents one or more surfaces suitable for standing on a plane.

For this purpose, the bottom abutment 11 is preferably placed at a distance from the base 4 of the receptacles 2, 3, said distance corresponding substantially to the thickness of the cap 5.

Thus, when the bottom face 18 of the cap 5 is made in co-operation with the bottom abutment 11, the top face of the cap 5 comes flush with the plane of the base 4.

This makes it possible to stand one of the faces of the container 1 on a plane.

Naturally, the longitudinal, transverse, and lateral axes 15, 17, and 16 are oriented by way of indication for the purposes of description. Other orientations relative to the configuration of the container 1 come within the ambit of the invention.

REFERENCES

1. Container
2. Receptacle
3. Second receptacle
4. Base
5. Cap
6*a*. Assembly face
6*b*. Assembly face
7. Step
8. Groove
9. Trough of groove
10. Edge of groove
11. Bottom abutment
12. Furrow
13. Ridge
14. Thread
15. Longitudinal axis
16. Lateral axis
17. Transverse axis
18. Bottom face of cap
19. Plane surface

What is claimed is:

1. A container constituted by two receptacles suitable for assembling to each other via respective ones of their faces, wherein the assembly face of each receptacle comprises in similar manner:

a transversely-extending step in the form of a groove; and a bottom abutment and a top abutment;

such that in a head-to-tail position, the trough of the groove of each receptacle co-operates with the edge of the groove of the other receptacle, and the bottom abutment of each receptacle co-operates with the top abutment of the other receptacle, so as to assemble the two receptacles together, blocking relative displace ment between them both in the transverse and in the longitudinal directions, wherein each receptacle presents a cap closing its opening, the bottom face of the cap constituting the top abutment, and wherein the bottom abutment is positioned at a distance from the base of the receptacle that corresponds substantially to the height of the cap.

2. A container according to claim 1, further comprising means for blocking the two receptacles laterally.

3. A container according to claim 2, wherein the blocking means are formed by at least one cavity formed in the assembly face of one of the receptacles and a portion in relief formed on the assembly face of the other receptacle, said portion in relief being suitable for inserting in the cavity.

4. A container according to claim 3, wherein each receptacle has both a cavity and a portion in relief.

5. A container according to claim 3, wherein the cavity is a furrow and the portion in relief is a ridge.

6. A container according to claim 1, wherein the groove is of rounded profile to facilitate assembly.

7. A container according to claim 1, wherein the bottom abutment is a plane surface facing towards the base of the receptacle.

8. A container according to claim 1, wherein each receptacle is made of a molded plastics material.

* * * * *